US008215077B1

(12) United States Patent
Dreyer

(10) Patent No.: US 8,215,077 B1
(45) Date of Patent: Jul. 10, 2012

(54) ADHESIVE INTERLOCKING FLOOR TILES

(76) Inventor: Steven I. Dreyer, Hollywood, FL (US)

( * ) Notice: Subject to any disclaimer, the term of this patent is extended or adjusted under 35 U.S.C. 154(b) by 0 days.

(21) Appl. No.: 13/134,314

(22) Filed: Jun. 6, 2011

Related U.S. Application Data

(63) Continuation-in-part of application No. 12/804,125, filed on Jul. 14, 2010.

(60) Provisional application No. 61/339,882, filed on Mar. 10, 2010.

(51) Int. Cl.
*E04F 15/02* (2006.01)
*E04B 1/61* (2006.01)

(52) U.S. Cl. ..... 52/588.1; 52/177; 52/590.1

(58) Field of Classification Search ..... 404/41, 404/35; 52/177, 588.1, 590.1, 390, 574, 52/586.2, 591.4
See application file for complete search history.

(56) References Cited

U.S. PATENT DOCUMENTS

| | | | | |
|---|---|---|---|---|
| 2,189,218 | A | 2/1940 | Neumeister | |
| 3,635,280 | A * | 1/1972 | Parsons | 164/246 |
| 3,657,852 | A | 4/1972 | Worthington | |
| 4,242,390 | A * | 12/1980 | Nemeth | 428/47 |
| 5,787,654 | A | 8/1998 | Drost | |
| 5,791,114 | A | 8/1998 | Mandel | |
| 5,913,781 | A | 6/1999 | Vidmar et al. | |
| 5,950,378 | A | 9/1999 | Council et al. | |
| 5,992,106 | A | 11/1999 | Carling et al. | |
| 6,089,784 | A | 7/2000 | Ardern | |
| 6,098,354 | A | 8/2000 | Skandis | |
| 6,682,254 | B1 | 1/2004 | Olofsson et al. | |
| 6,751,912 | B2 | 6/2004 | Stegner et al. | |
| 6,769,219 | B2 | 8/2004 | Schwitte et al. | |
| 6,802,159 | B1 | 10/2004 | Kotler | |
| 6,820,386 | B2 * | 11/2004 | Kappeli et al. | 52/591.4 |
| 6,851,241 | B2 * | 2/2005 | Pervan | 52/592.1 |
| 7,340,865 | B2 | 3/2008 | Vanderhoef | |
| 7,458,191 | B2 | 12/2008 | Stone | |
| 7,571,572 | B2 | 8/2009 | Moller, Jr. | |
| 7,793,471 | B2 * | 9/2010 | Hill | 52/177 |
| 8,006,460 | B2 * | 8/2011 | Chen et al. | 52/592.1 |
| 2003/0131549 | A1 | 7/2003 | Kappeli et al. | |
| 2006/0070314 | A1 | 4/2006 | Jenkins et al. | |
| 2007/0044412 | A1 | 3/2007 | Forster et al. | |
| 2009/0031662 | A1 * | 2/2009 | Chen et al. | 52/515 |
| 2011/0179728 | A1 * | 7/2011 | Cerny et al. | 52/177 |

* cited by examiner

*Primary Examiner* — Brian Glessner
*Assistant Examiner* — Joseph J Sadlon
(74) *Attorney, Agent, or Firm* — Alvin S. Blum

(57) ABSTRACT

A floor tile has a rectangular, wear resistant, decorated upper portion. A rectangular lower portion is affixed to the upper portion by pressure sensitive adhesive on the underside of the upper portion. The lower portion has laterally projecting tongues extending outwardly from two adjacent sides. The other two adjacent sides have inwardly directed pockets. The pockets are adapted to receive the tongues of adjacent tiles to form a continuous upper portion floor covering with minimal spacing between tiles. Certain edges of the tongues and pockets are close fitting to ensure correct positioning of adjacent upper portions. The pressure sensitive adhesive above each pocket is adapted to bond with a tongue when the tiles are connected after positioning by the tongues and pockets.

5 Claims, 7 Drawing Sheets

ADHESIVE INTERLOCKING FLOOR TILES

This application is a continuation in part of utility patent application Ser. No. 12/804,125 filed Jul. 14, 2010 and claims the benefit of provisional application for patent Ser. No. 61/339,882 filed Mar. 10, 2010, incorporated herein by reference in its entirety.

FIELD OF THE INVENTION

This invention relates generally to floor tiles with a decorative top that emulate ceramic or stone tiles or wood planks, and more particularly to floor tiles that interconnect to lock together with adhesives to form a continuous floating floor covering.

BACKGROUND OF THE INVENTION

U.S. Pat. Nos. 6,820,386 issued Nov. 23, 2004 to Kappeli and 3,657,852 issued Apr. 25, 1972 to Worthington review the prior art on floor tiles having locking mechanisms consisting of tongues that interlock with pockets underneath the visible surface portion. They both teach forming a continuous floor covering that is not adherent to the substrate floor. Their objective of providing a floating floor covering that will not be disrupted by movement of the underlying floor is achieved. Fitting the pockets over the closely fitting tongues during installation is difficult, because the process is obscured by the overlying visible portion. This greatly increases the installation problems and costs. U.S. Pat. No. 5,791,114 issued Aug. 11, 1998 to Mandel teaches the tongue and pocket interlocking method of forming a floor covering. It makes the interlocking mechanism visible by having the tongues and pockets extend all the way through the tile, including the top portion. However, because the joints are visible, they must be very tight. This makes the installation process difficult, because it takes excessive time and effort to fit each tongue into its corresponding pocket.

SUMMARY OF THE INVENTION

It is accordingly an object of the invention to provide floor tiles that lock together with adhesives to form a floating floor covering. The term "floor tile" is intended to include, but not limited to, floor tiles and floor planks that are laminated rubber and plastic in various compositions. Each tile has an upper portion that is rectangular in shape with smooth straight sides and dimensioned to fit against adjacent tiles to form a smooth traffic surface with no more than optional minimal groove at their interfaces to emulate a grout line. Said rectangular shape includes, but is not limited to, equilateral rectangles, i.e. square, as well as elongate rectangles, i.e. plank, tiles. A rectangular lower portion of each tile has two adjacent straight sides that have tongues that extend outwardly from their sides. The other two adjacent straight sides have tongue receiving pockets within their sides to each receive a tongue of an adjacent tile. The tongues and pockets are positioned relative to the upper portions to ensure close approximation of the upper portions to one another. The pockets are positioned under the top portion, and the tongues extend beyond the top portion. The tongues and pockets are constructed to facilitate insertion of the tongues within the pockets. The overlying upper portions conceal the tongues and pockets. The ease of insertion is achieved by limiting close fitting of the tongue into the pocket of only those edges that ensure correct positioning of the adjacent tiles. All other edges are loose fitting so that they do not resist the fitting of the tongue in the pocket.

The edges of the tongue not held tightly in the pocket do not compromise the positioning of the tiles to one another. After the adjacent tiles are positioned by the tongue and pocket action, the position is maintained by adhesive action from pressure sensitive adhesive. The adhesive is on the underside of the upper portion at the pocket that comes into contact with the top of the tongue when pressure is applied to the top portion to interlock the adjacent tiles together so as to form a continuous sheet from the individual tiles, with the interlocking elements hidden from view. The shape of the tiles may be large blocks to emulate ceramic or stone tiles with the upper surface displaying a corresponding pattern or other patterns. Alternatively, the surface may emulate wood grain, and the shape may emulate long wooden planks. The surface is constructed to resist wear.

These and other objects, features, and advantages of the invention will become more apparent from the detailed description of exemplary embodiments thereof as illustrated in the accompanying drawings, in which like elements are designated by like reference characters in the various drawing figures.

DETAILED DESCRIPTION OF PREFERRED EMBODIMENTS

Figure 1:
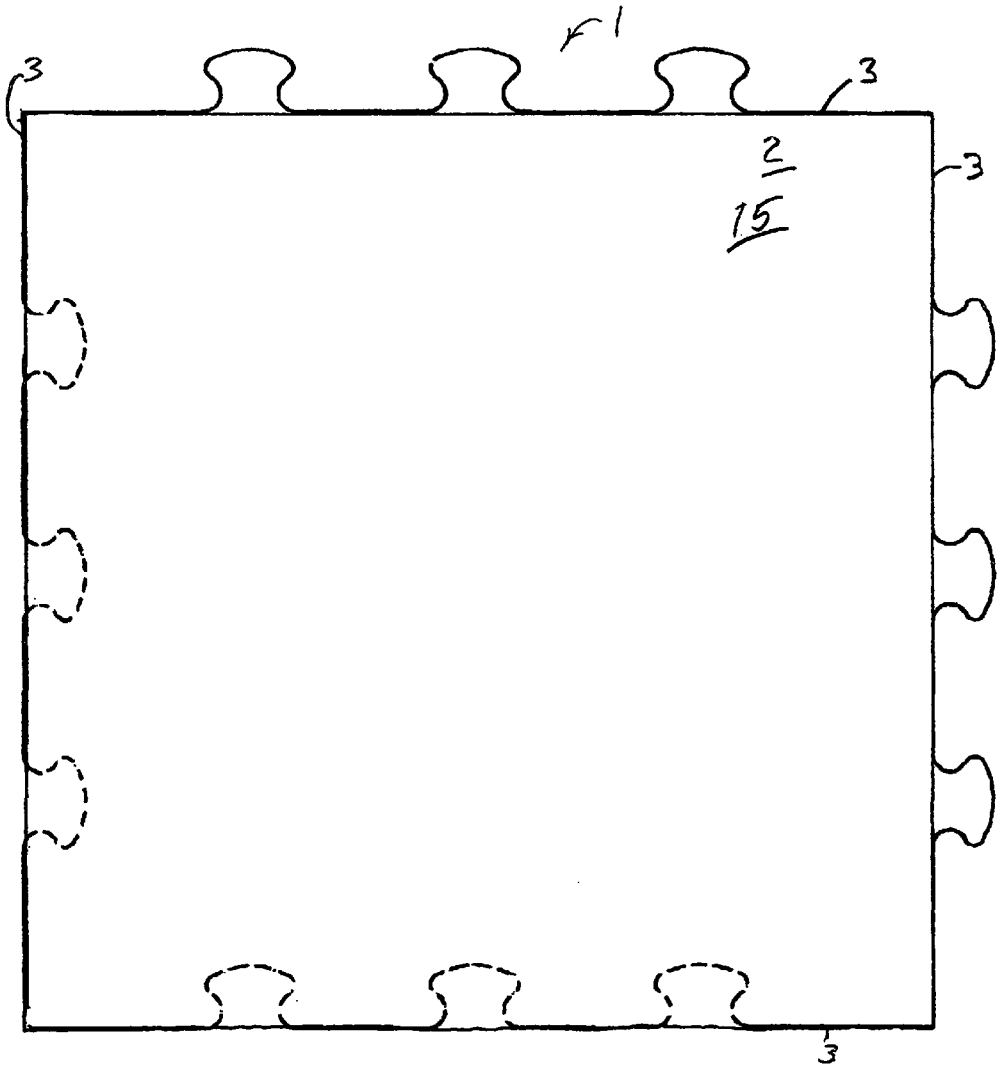
FIG. 1 is a top view of a tile of the invention
Figure 2:
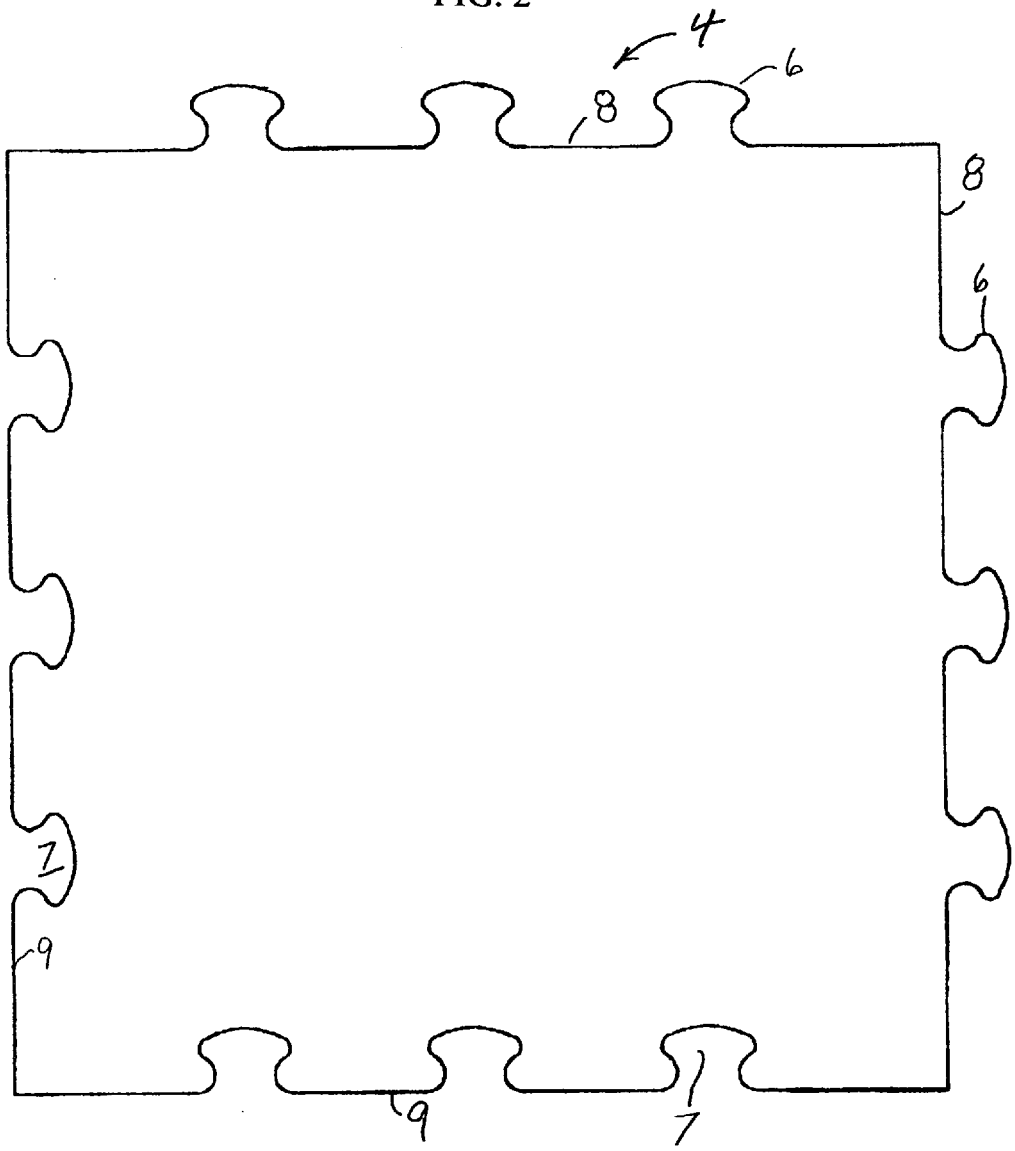
FIG. 2 is a top view of the lower portion of the tile
Figure 3:
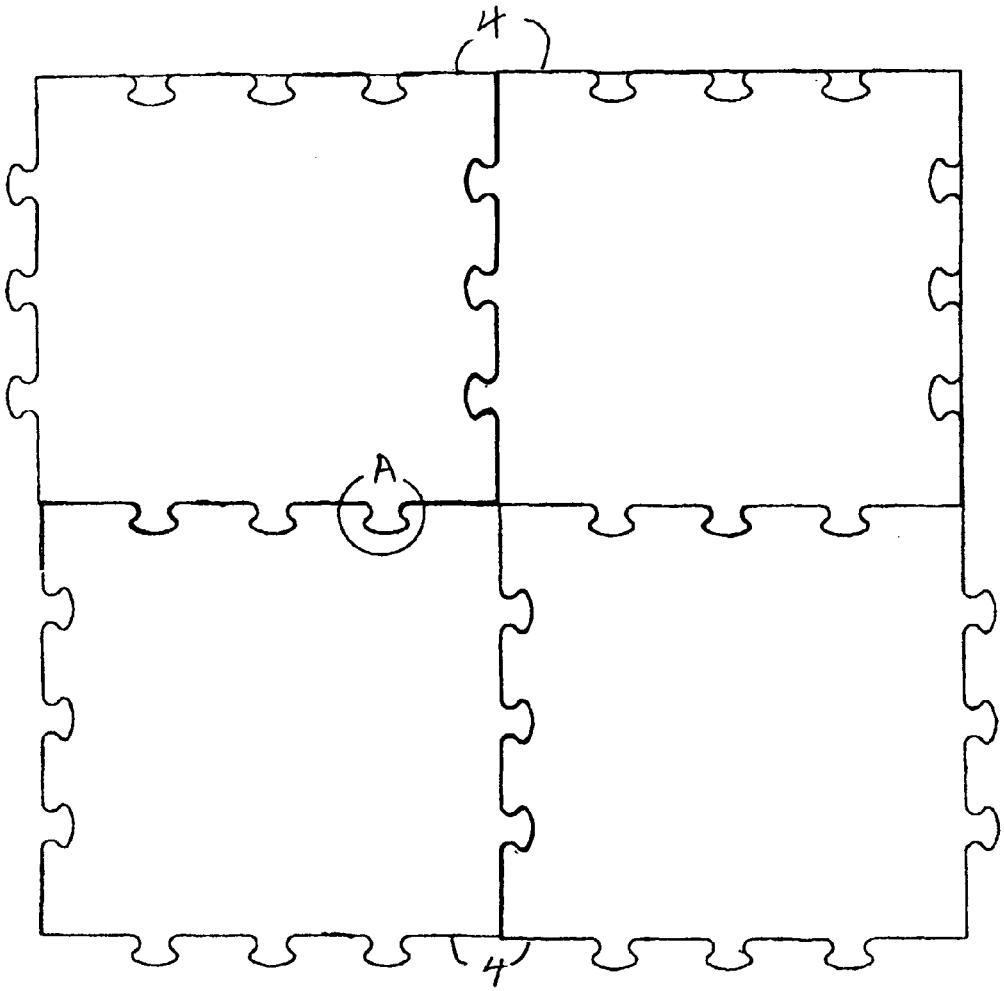
FIG. 3 is a bottom view of the tiles in interlocked condition.
Figure 4:
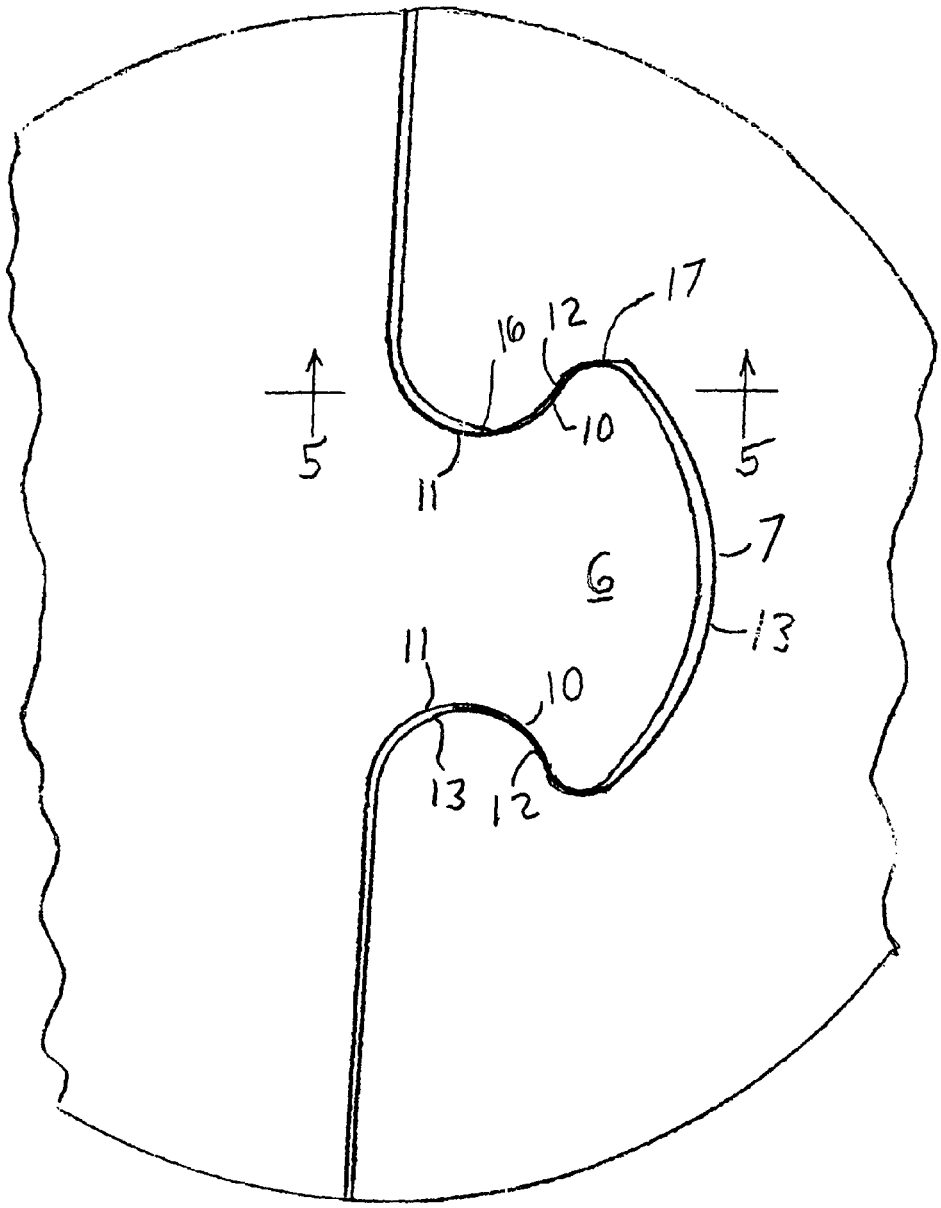
FIG. 4 is a detailed view of the portion A of FIG. 3.
Figure 5:
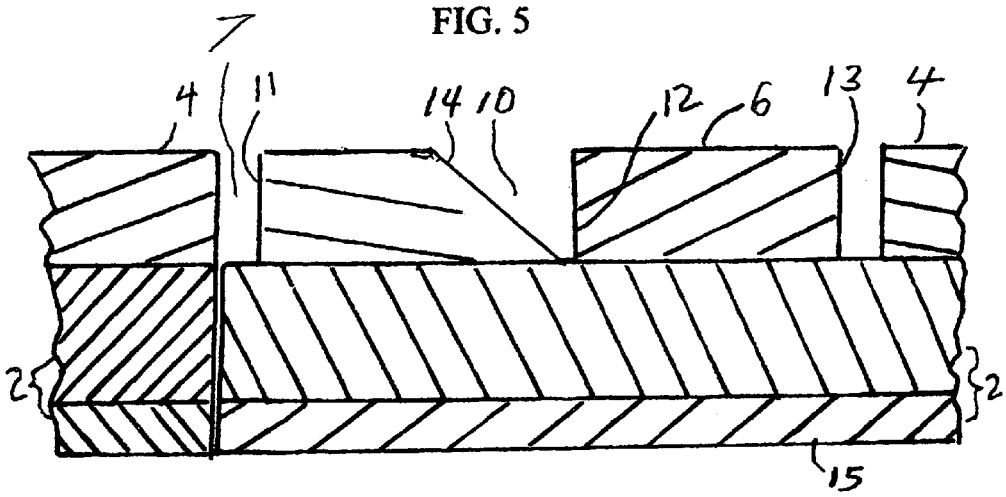
FIG. 5 is a sectional view through line 5-5 of FIG. 4.

Referring now first to the drawing FIGS. 1-5, floor tiles 1 of the invention have a rectangular upper portion 2 that is provided with a wear-resistant decorative upper surface 15 that may give the appearance, for example, but not limited to, ceramic or stone. The smooth straight sides 3 of the upper portion may have lengths dictated by esthetic or pragmatic considerations. The straight sides 3 are constructed to fit against the sides of adjacent tiles to form a smooth traffic surface with no more than optional minimal groove at their interface to emulate a grout line. A rectangular lower portion 4 is affixed to the upper portion 2 by a pressure sensitive adhesive layer 9 on the lower surface 5 of the upper portion 2. Hot melt pressure sensitive adhesive No. 628 from Fu Hong Chemical Co. Ltd. Taiwan has been found suitable for this application. Tongues 6 extend outwardly from two adjacent straight sides 8 of the lower portion. Pockets 7 extend inwardly from the other two adjacent straight sides 9 under the upper portion, so that the adhesive is exposed. The two sides that have pockets do not have tongues, and the two sides that have tongues do not have pockets. The tongues have a stalk 16 of a certain width extending from the body of the lower portion and a head 17 of a greater width attached to the stalk.

Figure 9:
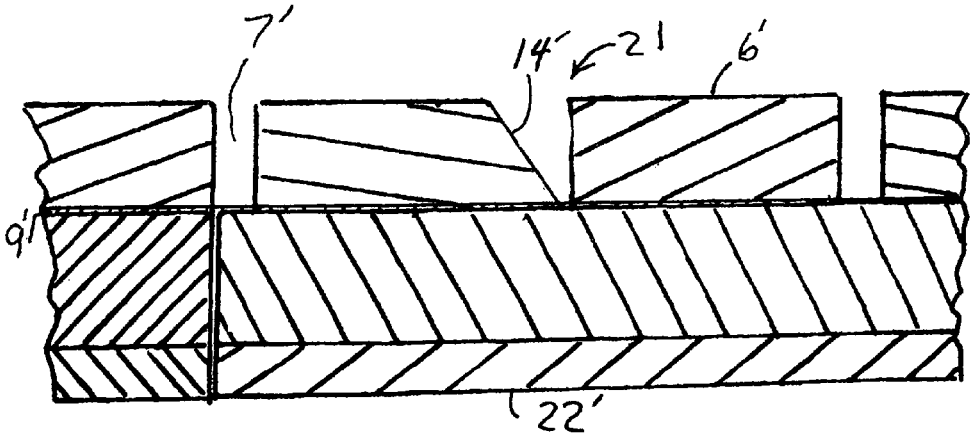
FIG. 9 is a sectional view through line 9-9 of FIG. 8.
Figure 6:
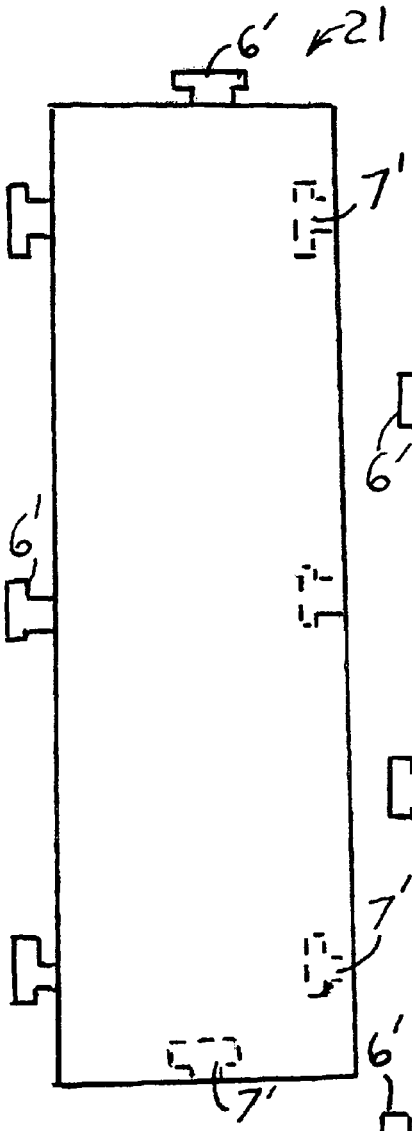
FIG. 6 is a top view of another embodiment of the invention.
Figure 7:
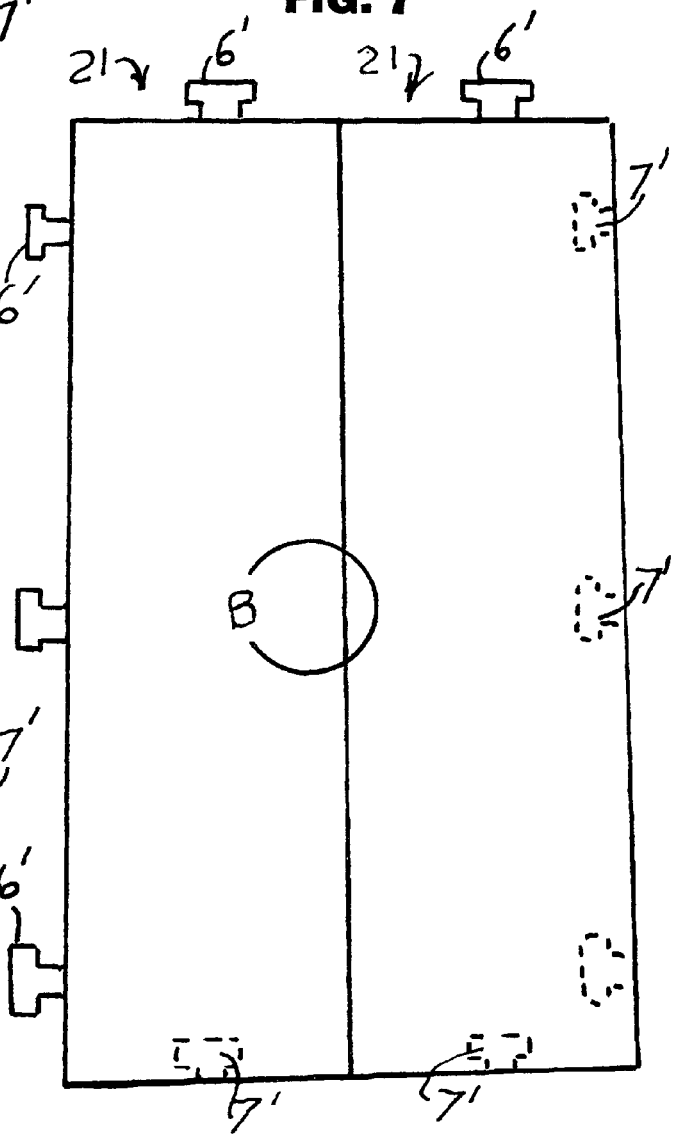
FIG. 7 is a top view of two tiles of FIG. 6 locked together.
Figure 8:
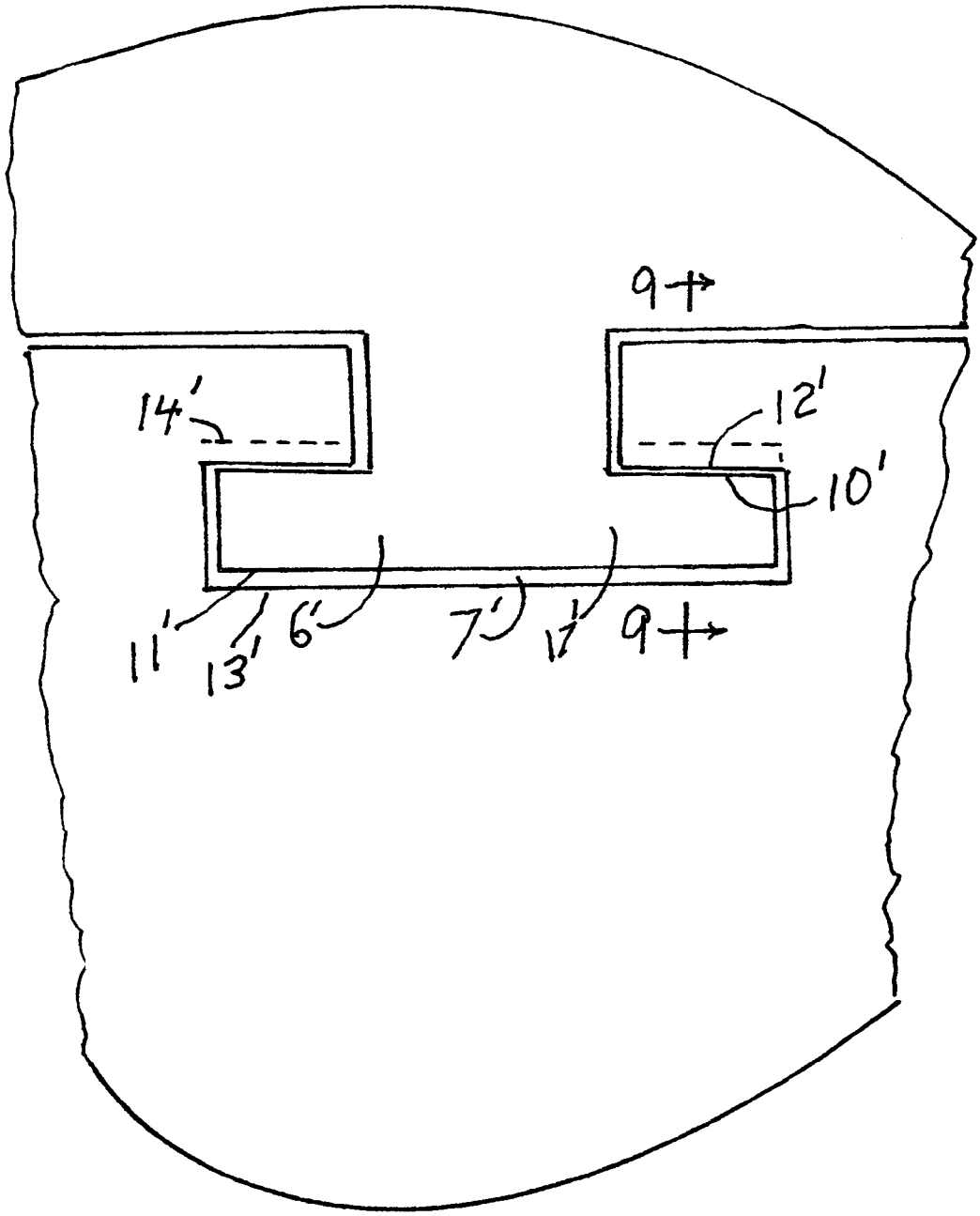
FIG. 8 is a detailed bottom view of area B of FIG. 7.

The tongues and pockets are constructed so that the pockets 7 fit onto the tongues 6 of adjacent tiles. The construction of the tongues and pockets provides for certain edges 12 of the pockets to fit closely against certain edges 10 of the heads 17 of the tongues that prevent movement of adjacent tiles away from each other to thereby establish close fit of the top portions of adjacent tiles to one another. The other edges 13 of the pockets that do not prevent that movement of adjacent tiles from one another do not touch the edges 11 of the tongues so that their loose fitting facilitates installation. To further facilitate installation, a close fitting edge 10 of the pocket may optionally have the bevel 14 (shown in phantom). The shape of the tongues and pockets may be curvilinear as shown in FIGS. 1-5, or rectilinear as shown in FIGS. 6-9. When the pocket is applied to the tongue, the exposed adhesive 9' on the underside of the upper portion at the pocket joins the two together permanently. When packing the tiles one atop the other, a release sheet may be interleafed to prevent inadvertent adhesion. The interlocked tongues and pockets are not visible after installation because they are part of the bottom portions that are covered by the upper portions so that only uninterrupted smooth straight side seams of adjacent tiles are visible to the using public.

Referring now to another embodiment of the invention shown in FIGS. 6-9, floor tiles 21 of the invention are an elongate rectangle having a wear resistant upper surface 22' on an upper portion decorated to emulate, for example, but not limited to, wood flooring hoards. The floor tiles have a lower portion that is provided with tongues 6' and pockets 7' for positioning, and that are interlocked by adhesive 9' as described above, to thereby form a single complete sheet of floor covering from the individual tiles. The construction of the tongues 6' and pockets 7' of this embodiment provides for certain edges 12' of the pockets to fit closely against certain edges 10' of the heads 17' of the tongues that prevent movement of adjacent tiles away from each other to establish close fit and position of the top portions of adjacent tiles. The other edges 13' of the pockets do not touch the edges 11' of the tongues so that their loose fitting facilitates installation. To further facilitate installation, a close fitting edge 12' of the pocket may optionally have the bevel 14'.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

The invention claimed is:

1. A plurality of interlocking floor tiles comprising:

a rectangular upper first portion of each tile having a decorative wear-resistant upper traffic surface, and smooth straight sides dimensioned to fit closely against straight sides of adjacent tiles with minimal space therebetween;

a rectangular lower second portion, devoid of a decorative wear resistant surface, affixed to the upper portion by a pressure sensitive adhesive on a lower surface of the first portion, the second portion having straight sides;

a plurality of spaced-apart tongues extending outwardly from a first two adjacent straight sides of the second portion, each tongue having a stalk extending from a first straight side and a head, having a greater width than the stalk, attached to the stalk;

a plurality of spaced-apart pockets extending inwardly from a second two adjacent straight sides of the second portion opposite the first two adjacent straight sides of the second portion, exposing the adhesive on the lower surface of the first portion at the pocket;

the first two adjacent sides having no pockets;

the second two adjacent sides having no tongues;

the tongues and pockets so constructed that the pockets fit onto the tongues of adjacent tiles, when the first portion is positioned closely against first portions of adjacent tiles;

edges of the pocket and the head of the tongue that prevent movement of adjacent tiles away from each other being close fitting in order to precisely position upper first portions of adjacent tiles against one another, wherein the close fitting tongue is prevented from movement within the close fitting pocket and other edges of the pocket and tongue that do not prevent such movement being loose fitting to facilitate installation wherein the loose fitting tongue is allowed to move within the loose fitting pocket; and the exposed adhesive on the lower surface of the upper portion adapted to adhesively permanently engage the tongues.

2. The interlocking floor tiles according to claim 1 in which one of the close fitting edges is provided with a bevel to facilitate installation.

3. A plurality of interlocking floor tiles comprising:

a rectangular upper portion of each tile having a decorative wear-resistant upper traffic surface and straight sides dimensioned to fit closely against straight sides of upper portions of adjacent tiles with minimal space therebetween:

a rectangular lower portion having straight sides, the lower portion affixed to the upper portion by a pressure sensitive adhesive on a lower surface of the upper portion;

a plurality of spaced-apart tongues extending outwardly from a first two adjacent straight sides of the lower portion;

a plurality of spaced-apart pockets extending inwardly from a second two adjacent straight sides of the lower portion opposite the first two adjacent straight sides;

the first two adjacent sides having no pockets;

the second two adjacent sides having no tongues;

the lower portion affixed to the upper portion so that the pockets are beneath the upper portion, with adhesive exposed above the pockets and the tongues extend outwardly from beneath the upper portion;

the tongues and pockets so constructed that the pockets fit onto the tongues of adjacent tiles, when the upper portion is positioned closely against adjacent tiles, with the tongues and pockets being obscured by the upper portion;

edges of the pocket and tongue that prevent movement of adjacent tiles away from each other being close fitting for precise positioning of upper first portions of adjacent tiles against one another, wherein the close fitting tongue is prevented from movement within the close fitting pocket and other edges of the pocket and tongue that do not prevent that movement being loose fitting to facilitate installation wherein the loose fitting tongue is allowed to move within the loose fitting pocket; and the exposed adhesive on the lower surface of the upper portion adapted to adhesively and permanently engage the tongues.

4. The interlocking floor tiles according to claim 3 in which at least one of the close fitting edges is provided with a bevel to facilitate installation.

5. A plurality of interlocking floor tile comprising:

a rectangular first portion of each tile having a decorative wear-resistant upper traffic surface, and straight sides dimensioned to fit against straight sides of adjacent tiles;

a rectangular second portion affixed to the first portion by a pressure sensitive adhesive on a lower surface of the first portion, the second portion having four straight sides;

a plurality of spaced-apart tongues extending outwardly from a first two adjacent straight sides of the second portion;

a plurality of spaced-apart pockets extending inwardly from a second two adjacent straight sides of the second portion opposite the first two adjacent straight sides of the second portion, exposing the adhesive on the upper portion above the pocket;

the first two adjacent sides having no pockets;

the second two adjacent sides having no tongues;

the tongues and pockets so constructed that the pockets fit onto the tongues of adjacent tiles, when the first portion is positioned closely against first portions of adjacent tiles; and the exposed adhesive above the pocket being adapted to permanently engage the tongues to interlock the adjacent tiles after positioning action of the tongues and pockets at least one of said plurality of spaced apart tongues and one of said plurality of spaced apart pockets having a close fitting relationship;

wherein the close fitting tongue is prevented from movement within the close fitting pocket; and wherein the loose fitting tongue is allowed to move within the loose fitting pocket.

* * * * *